US009287642B2

(12) United States Patent
Hara

(10) Patent No.: US 9,287,642 B2
(45) Date of Patent: Mar. 15, 2016

(54) CONNECTOR HAVING A TIP END ABUTTING A CIRCUIT BOARD AND LOCKED IN A CONNECTOR RECEIVING MEMBER ATTACHED TO THE CIRCUIT BOARD

(71) Applicant: Yazaki Corporation, Minato-ku, Tokyo (JP)

(72) Inventor: Terufumi Hara, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/542,815

(22) Filed: Nov. 17, 2014

(65) Prior Publication Data

US 2015/0072542 A1 Mar. 12, 2015

Related U.S. Application Data

(63) Continuation of application No. PCT/JP2013/063735, filed on May 10, 2013.

(30) Foreign Application Priority Data

May 17, 2012 (JP) ..... 2012-113477

(51) Int. Cl.
*H01R 12/71* (2011.01)
*H01R 13/629* (2006.01)
(Continued)

(52) U.S. Cl.
CPC ..... *H01R 12/716* (2013.01); *H01R 12/714* (2013.01); *H01R 13/62938* (2013.01); *H01R 13/6315* (2013.01); *H01R 13/187* (2013.01)

(58) Field of Classification Search
CPC ..... H01R 12/712; H01R 112/714; H01R 12/716; H01R 12/718
USPC ..... 439/74–84, 157, 73, 153, 248, 345
See application file for complete search history.

(56) References Cited

U.S. PATENT DOCUMENTS 4,601,527 A * 7/1986 Lemke ..... H01R 23/6873 439/607.08
4,871,315 A 10/1989 Noschese
(Continued)

FOREIGN PATENT DOCUMENTS

EP 1130691 A2 9/2001
JP H08-335483 A 12/1996
(Continued)

OTHER PUBLICATIONS

Aug. 1, 2013—International Search Report and Written Opinion—Int'l App PCT/JP2013/063735.
(Continued)

*Primary Examiner* — Chandrika Prasad
(74) *Attorney, Agent, or Firm* — Banner & Witcoff, Ltd.

(57) ABSTRACT

A board connector includes: a connector body housing a terminal fitting and connected to a contact arranged on a circuit board; and a connector receiving member attached to the circuit board and engagingly locking a tip end surface of the connector body in a state where the tip end surface is butted against a surface of the circuit board. The connector body includes: an inner housing which engagingly locks the terminal fitting so that a tip end surface of the terminal fitting is projected from the tip end surface of the connector body; an outer housing which supports the inner housing so that the inner housing is slidable in a fitting direction; and a housing urging spring which urges the inner housing. The tip end surface of the terminal fitting is pressingly contacted with the contact, thereby causing the terminal fitting to be electrically connected to the contact.

4 Claims, 21 Drawing Sheets

(51) Int. Cl.
*H01R 13/631* (2006.01)
*H01R 13/187* (2006.01)

(56) References Cited

U.S. PATENT DOCUMENTS

| | | | | |
|---|---|---|---|---|
| 5,516,303 | A | 5/1996 | Yohn et al. | |
| 5,540,599 | A | 7/1996 | Bishop | |
| 6,361,337 | B2 | 3/2002 | Kurimoto | |
| 6,830,469 | B1 | 12/2004 | Doyle et al. | |
| 8,033,844 | B2 | 10/2011 | Kobayashi et al. | |
| 2001/0021599 | A1 | 9/2001 | Kurimoto | |
| 2007/0020978 | A1 | 1/2007 | Murakami et al. | |
| 2009/0004889 | A1* | 1/2009 | Sakamoto | H01R 13/629 439/59 |
| 2011/0053405 | A1 | 3/2011 | Kobayashi et al. | |
| 2013/0157523 | A1* | 6/2013 | Hara | H01R 13/05 439/867 |
| 2015/0004812 | A1* | 1/2015 | Hara | H01R 12/714 439/76.1 |

FOREIGN PATENT DOCUMENTS

| | | | |
|---|---|---|---|
| JP | 2006-331996 | A | 12/2006 |
| JP | 2010-219014 | A | 9/2010 |
| JP | 2010-262854 | A | 11/2010 |
| JP | 2011-070827 | A | 4/2011 |
| WO | 94-11925 | A1 | 5/1994 |
| WO | 2009-129062 | A1 | 10/2009 |
| WO | 2012-015074 | A1 | 2/2012 |

OTHER PUBLICATIONS

Jan. 5, 2016—(JP) Notification of Reasons for Refusal—App 2012-113477, Eng Tran.

* cited by examiner

CONNECTOR HAVING A TIP END ABUTTING A CIRCUIT BOARD AND LOCKED IN A CONNECTOR RECEIVING MEMBER ATTACHED TO THE CIRCUIT BOARD

CROSS REFERENCE TO RELATED APPLICATIONS

This application is a continuation of PCT application No. PCT/JP2013/063735, which was filed on May 10, 2013 based on Japanese Patent Application (No. 2012-113477) filed on May 17, 2012, the contents of which are incorporated herein by reference.

BACKGROUND OF THE INVENTION

1. Field of the Invention

The present invention relates to a board connector through which terminal fittings connected to cables extended from an external apparatus are electrically connected to contact patterns arranged on a circuit board at a predetermined arrangement pitch, respectively.

2. Description of the Related Art

FIG. 21 shows a related-art example of a board connector. The board connector 100 is disclosed in PTL 1.

The board connector 100 includes a resin-made connector housing 110 which is to be mounted on a circuit board 200, and a plurality of needle-shaped male terminal fittings 120 which are embedded in the connector housing 110.

In each of the male terminal fittings 120, one end 121 is located in the connector housing 110. The other end 122 of the male terminal fitting 120 is extended from the rear end of the connector housing 110, then bent toward the circuit board 200, and inserted and passed through a through hole 201 formed in the circuit board 200.

The other end 122 of the male terminal fitting 120 which is inserted and passed through the through hole 201 is soldered to a contact pattern formed on the through hole 201, to be electrically connected to a contact pattern formed on the circuit board 200. The male terminal fittings 120 are soldered to the contact patterns, whereby the board connector 100 is fixed to the circuit board 200.

Although not shown, an apparatus-side connector which is connected to cables extended from an external apparatus is fittingly connected to the board connector 100. The apparatus-side connector has a configuration where female terminal fittings which are to be matingly fitted to one ends 121 of the male terminal fittings 120, respectively are housed and held.

CITATION LIST

Patent Literature

[PTL 1] JP-A-2011-70827

The above-describe board connector 100 has a problem in that, when the board connector 100 is to be connected to the circuit board 200, time-consuming soldering work is required.

In order to electrically connect the cables extended from the external apparatus to the contact patterns on the circuit board 200, it is necessary to fit the apparatus-side connector to the board connector 100, and then matingly fit the terminal fittings held on the connectors to each other. There is a possibility that, when the terminal fittings of the connectors are to be matingly fitted to each other, the terminal fittings may be caused to be broken by collision or prying between the terminal fittings.

SUMMARY OF THE INVENTION

Therefore, it is an object of the invention to solve the above-discussed problems and provide a board connector in which it is not necessary to conduct time-consuming soldering work on a circuit board, there is no possibility that, during a connecting operation, terminal fittings may be caused to be broken by collision or prying, and the terminal fittings connected to cables extended from an external apparatus can be easily electrically connected to contact patterns of the circuit board.

According to the invention, there is provided a board connector comprising: a connector body which houses and holds a terminal fitting connected to a cable extended from an external apparatus and corresponding to a contact pattern arranged on a circuit board; and a connector receiving member which is attached to the circuit board, and which engagingly locks a tip end surface of the connector body in a state where the tip end surface of the connector body is butted against a surface of the circuit board, wherein the connector body includes: an inner housing which engagingly locks the terminal fitting so that a tip end surface of the terminal fitting is projected from the tip end surface of the connector body; an outer housing which supports the inner housing so that the inner housing is slidable in a fitting direction along which the connector body and the connector receiving member are fitted to each other; and a housing urging spring which is disposed between the inner housing and the outer housing in a compressed state to urge the inner housing in a projecting direction along which the inner housing is projected from the outer housing, and the tip end surface of the terminal fitting is pressingly contacted with the contact pattern, thereby causing the terminal fitting to be electrically connected to the contact pattern.

The terminal fitting may include a contact portion which is contacted with the contact pattern and which is a spring piece configured to perform predetermined elastic deformation by being contacted with the contact pattern, thereby exerting a predetermined contact pressure on the contact pattern.

When the contact portion of the terminal fitting performs the elastic deformation by being contacted with the contact pattern, the contact portion is elastically displaced in a surface direction of the contact pattern so as to scrub a surface of the contact pattern.

The connector receiving member may include a tubular portion to which the connector body is fitted and which includes a boss portion protruded from an outer surface of the tubular portion, and the connector body may include a fitting operation lever which is configured to perform a swinging operation and which is formed with a cam groove that is configured to pull in the boss portion in the fitting direction in accordance with the swinging operation of the fitting operation lever, thereby causing the connector body to be fitted to the connector receiving member.

According to an aspect of the invention, electrical connections between the terminal fittings connected to the cables extended from an external apparatus, and the contact patterns on the circuit board are realized by coupling the connector body to the connector receiving member on the circuit board, and butting the tip end surface of the connector body against the surface of the circuit board, to butt the tip end surfaces of the terminal fittings held by the connector body, against the contact patterns on the circuit board. When the cables extended from the external apparatus are to be electrically connected to the contact patterns on the circuit board, therefore, it is not necessary to conduct time-consuming soldering work on the circuit board.

Moreover, the electrical connections between the terminal fittings connected to the cables extended from the external apparatus and the contact patterns on the circuit board are realized by contact due to butting of the terminal fittings and the contact patterns, and mating fittings of the terminal fittings which may cause collision or prying during a connecting operation do not exist. Consequently, there is no possibility that the terminal fittings may be broken by collision or prying during a connecting operation.

Therefore, the terminal fittings connected to the cables extended from the external apparatus can be easily electrically connected to the contact patterns on the circuit board.

In a state where the connector body is coupled to the connector receiving member, the inner housing which engagingly locks the terminal fittings is urged toward the circuit board by the housing urging springs. Therefore, the terminal fittings engagingly locked by the inner housing can be pressingly contacted with the contact patterns at a predetermined contact pressure. Moreover, dimension and assembly errors of the connector body can be absorbed by extension and contraction of the housing urging springs. Therefore, a stable electrical connection state can be ensured without being affected by dimension and assembly errors of the connector body, and the reliability of the connections between the contact patterns and the terminal fittings can be improved.

According to an aspect of the invention, in the terminal fittings, the contact portions which are to be butted against the contact patterns are provided by the spring pieces which are caused to perform predetermined elastic deformation by being butted against the contact patterns, thereby exerting the predetermined contact pressure on the contact patterns. As compared with the case where the tip ends of the terminal fittings are pressingly contacted with the contact patterns by only the urging forces of the housing urging springs, therefore, the contact pressures can be further finely adjusted, the shock which acts on the terminal fittings in the press contact can be relaxed, and the reliability of the connections between the contact patterns and the terminal fittings can be further improved.

According to an aspect of the invention, when the contact portions of the terminal fittings are butted against the contact patterns on the circuit board, the contact portions scrub the surfaces of the contact patterns during the elastic deformation, respectively, and wiping which is effective in removal of oxide films on the contacting surfaces is performed. Therefore, reduction of electrical connection characteristics due to such oxide films can be prevented from occurring.

According to an aspect of the invention, the coupling between the connector body and the connector receiving member can be easily realized by swinging the fitting operation lever, and the work of coupling the connector body with the connector receiving member can be facilitated.

According to an aspect of the invention, electrical connections between the terminal fittings connected to the cables extended from an external apparatus, and the contact patterns on the circuit board are realized by butting the tip end surfaces of the terminal fittings held by the connector body, against the contact patterns on the circuit board. When the cables extended from the external apparatus are to be electrically connected to the contact patterns on the circuit board, therefore, it is not necessary to conduct time-consuming soldering work on the circuit board.

Moreover, the electrical connections between the terminal fittings connected to the cables extended from the external apparatus and the contact patterns on the circuit board are realized by contact due to butting of the terminal fittings and the contact patterns, and mating fittings of the terminal fittings which may cause collision or prying during a connecting operation do not exist. Consequently, there is no possibility that the terminal fittings may be broken by collision or prying during a connecting operation.

Therefore, the terminal fittings connected to the cables extending from the external apparatus can be easily electrically connected to the contact patterns on the circuit board.

In a state where the connector body is coupled to the connector receiving member, the inner housing which engagingly locks the terminal fittings is urged toward the circuit board by the housing urging springs. Therefore, the terminal fittings engagingly locked to the inner housing can be pressingly contacted with the contact patterns at a predetermined contact pressure. Moreover, dimension and assembly errors of the connector body can be absorbed by extension and contraction of the housing urging springs. Therefore, a stable electrical connection state can be ensured without being affected by dimension and assembly errors of the connector body, and the reliability of the connections between the contact patterns and the terminal fittings can be improved.

In the above, the invention has been briefly described. When a mode for carrying out the invention (hereinafter, referred to as "embodiment") which will be described below is through read with reference to the accompanying drawings, a detail of the invention will be further clarified.

DETAILED DESCRIPTION OF THE EXEMPLARY EMBODIMENTS

Hereinafter, a preferred embodiment of the board connector of the invention will be described in detail with reference to the drawings.

Figure 1:
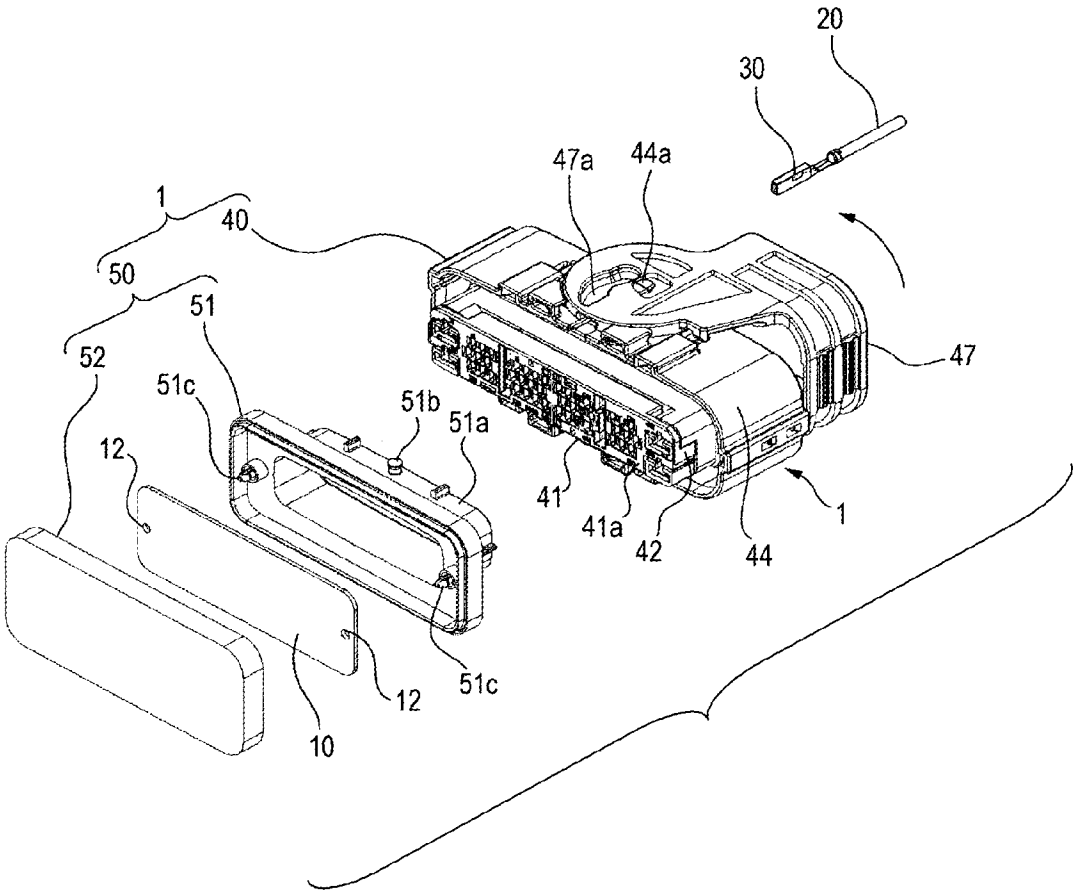
FIG. 1 is an exploded perspective view of an embodiment of the board connector of the invention.
Figure 4:
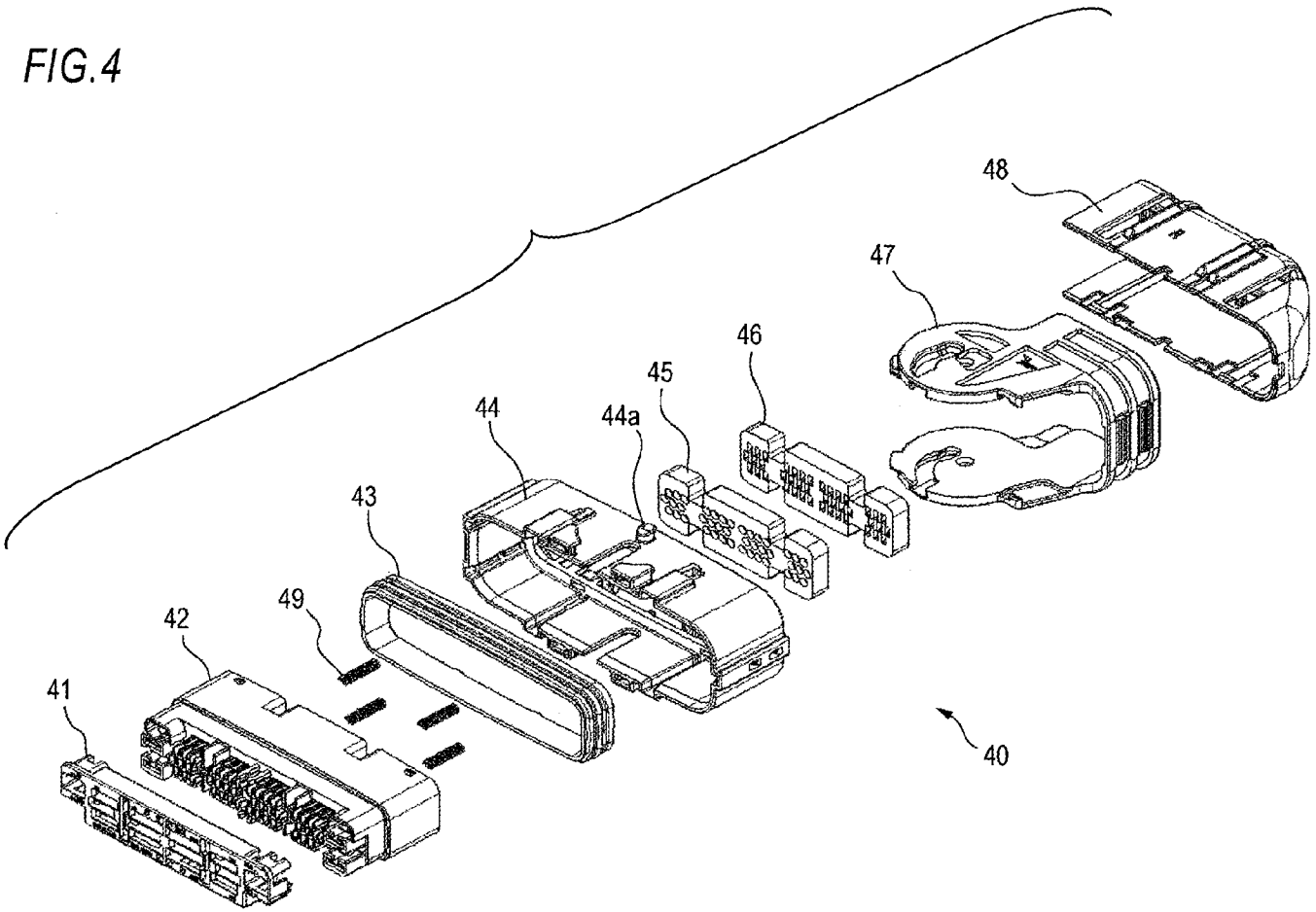
FIG. 4 is an exploded perspective view of a connector body shown in FIG. 1.
Figure 5:
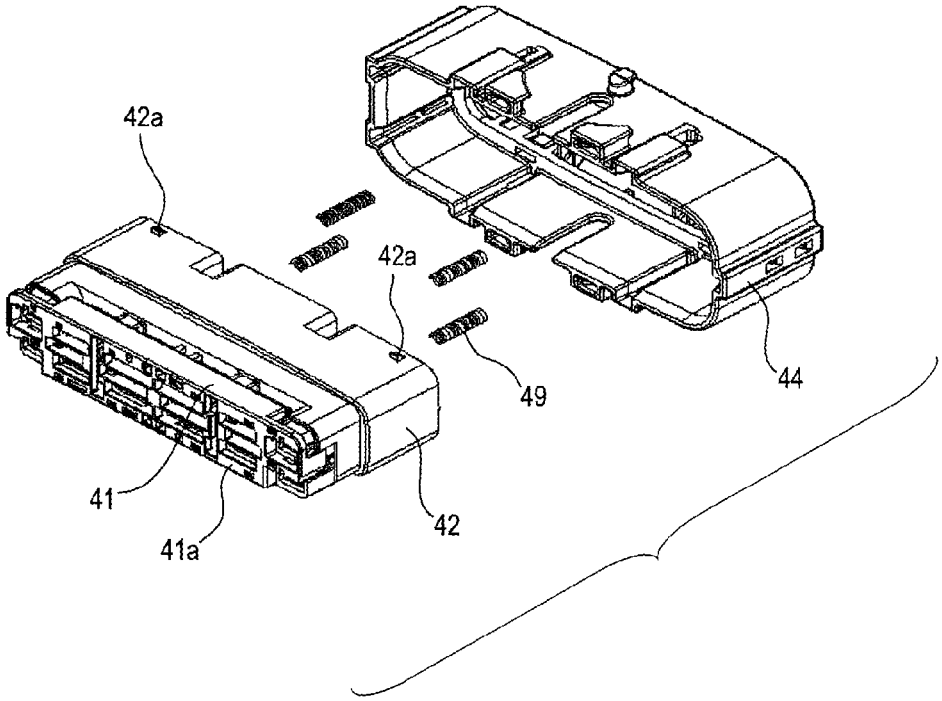
FIG. 5 is a perspective view of a state where inner and outer housings in the embodiment to which housing urging springs have not yet been attached are opposed to each other before assembly.
Figure 6:
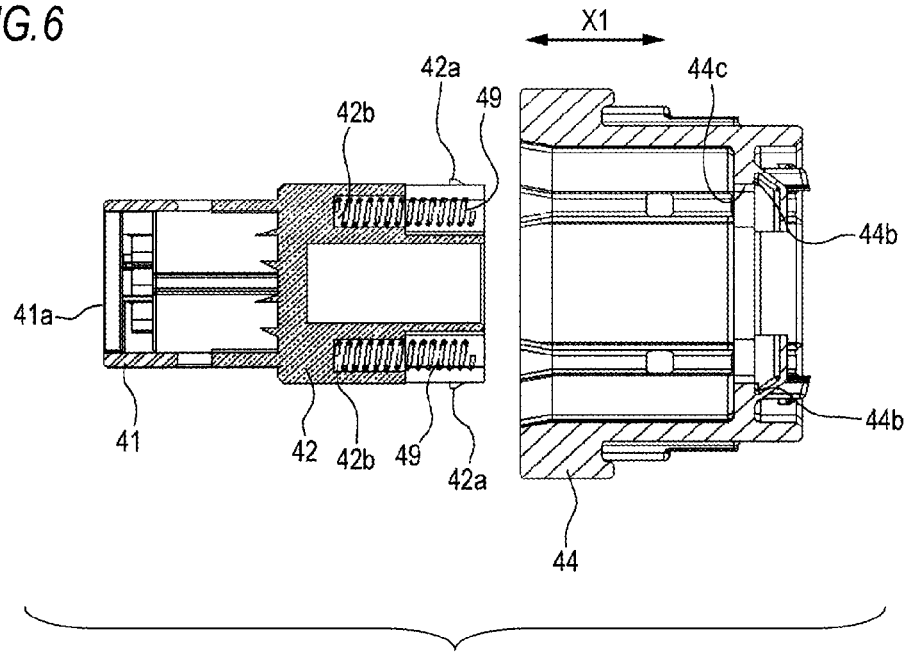
FIG. 6 is a perspective view of a state where the inner and outer housings in the embodiment to which the housing urging springs have been attached are opposed to each other before assembly.
Figure 7:
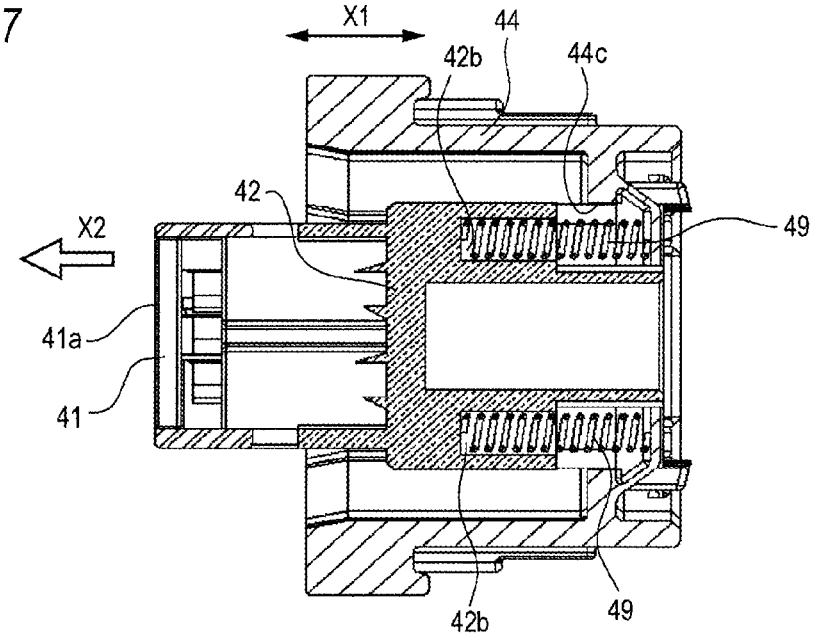
FIG. 7 is a longitudinal sectional view of the inner and outer housings in the embodiment after assembly.
Figure 8:
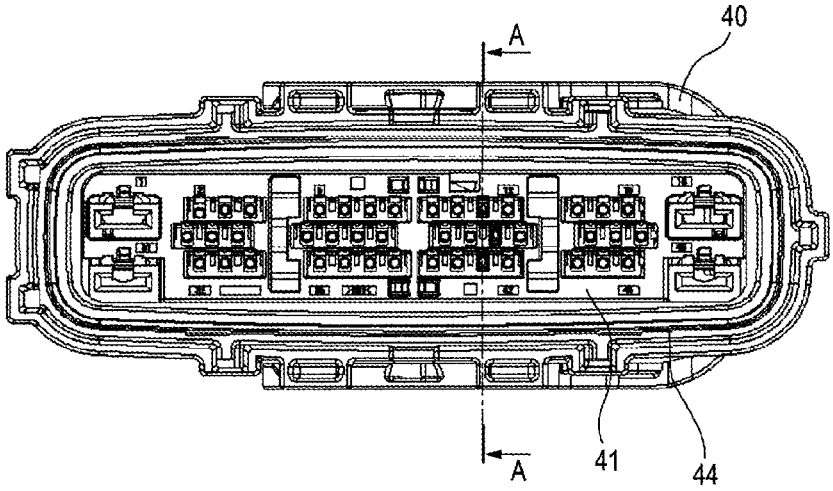
FIG. 8 is a front view of the connector body in the embodiment after assembly.
Figure 9:
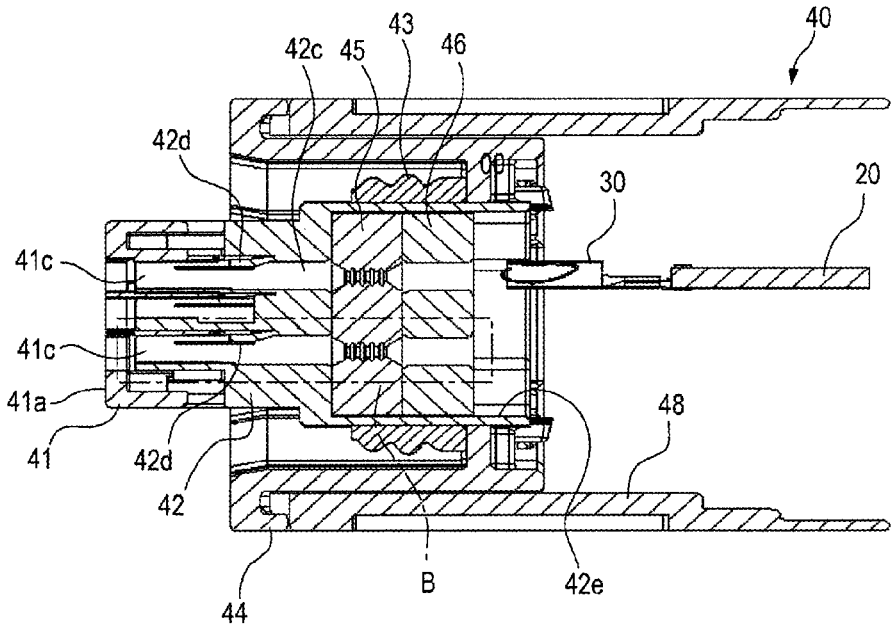
FIG. 9 is a sectional view taken along A-A in FIG. 8.
Figure 10:
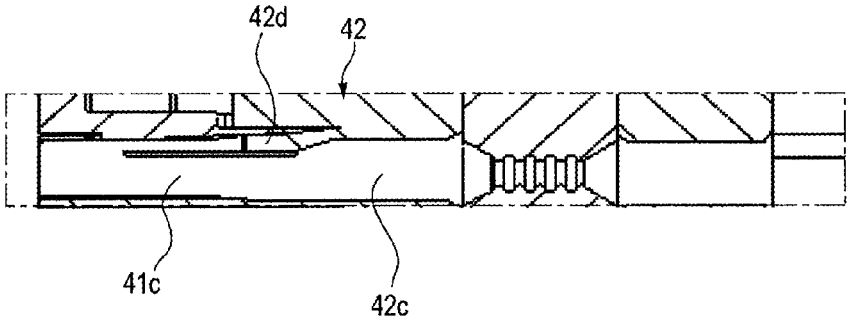
FIG. 10 is an enlarged view of portion B of FIG. 9.
Figure 11:
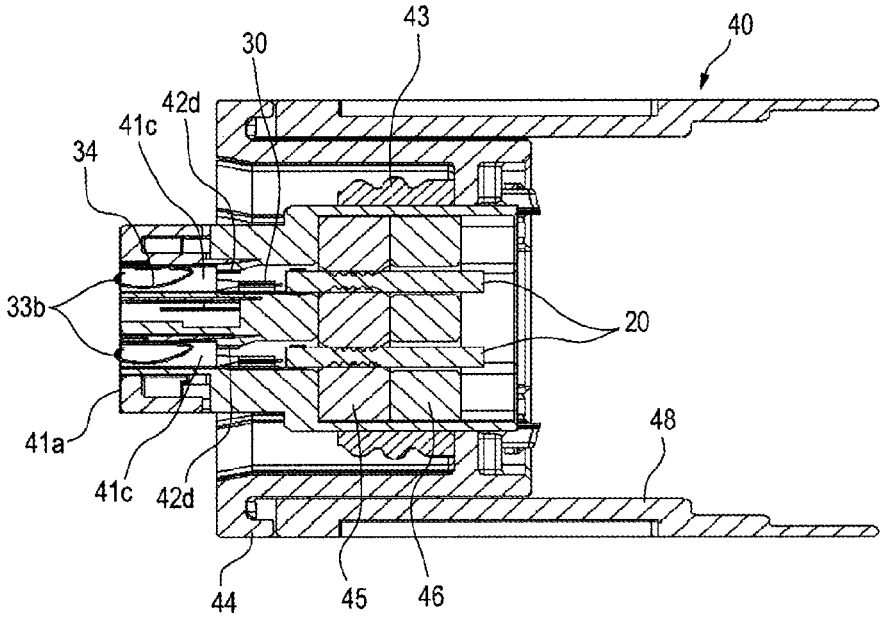
FIG. 11 is a longitudinal sectional view of a state where terminal fittings are attached to the connector body in the embodiment.
Figure 12:
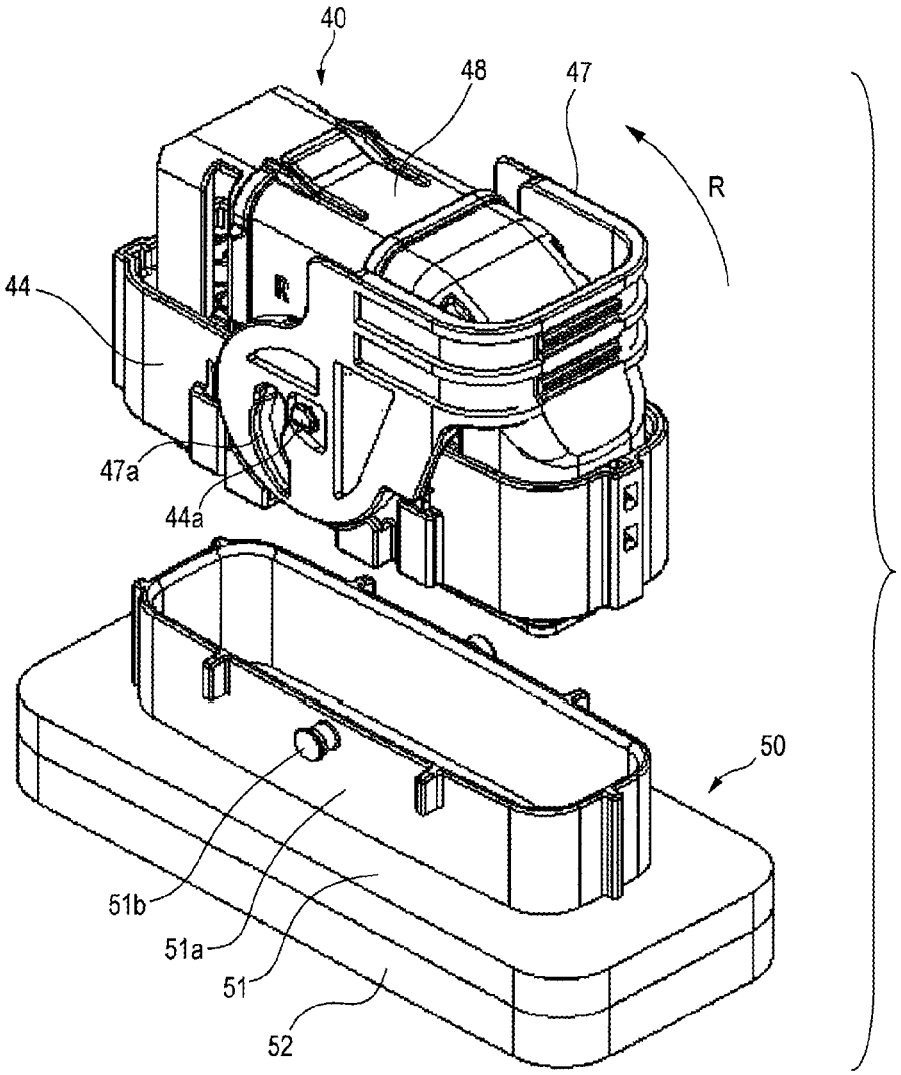
FIG. 12 is a perspective view of a state where, in the embodiment, a connector receiving member and the connector body are opposed to each other.
Figure 13:
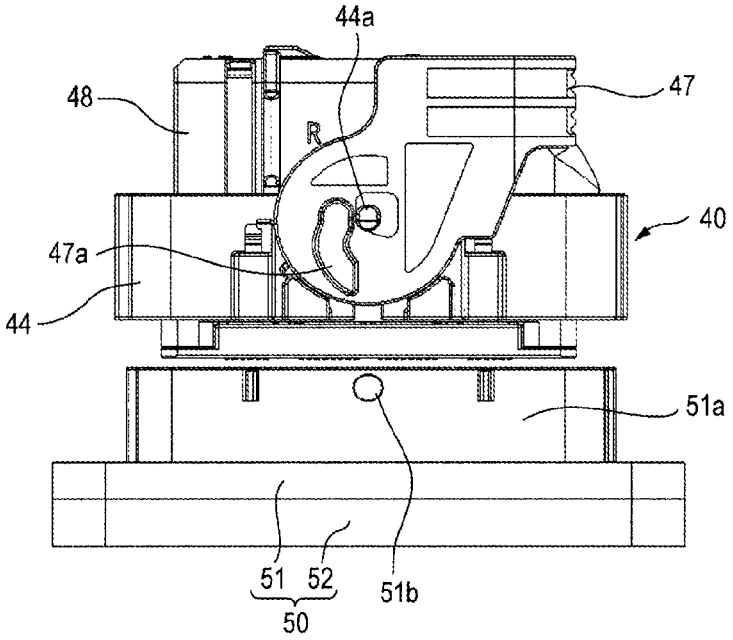
FIG. 13 is a side view of the connector receiving member and connector body shown in FIG. 12.
Figure 14:
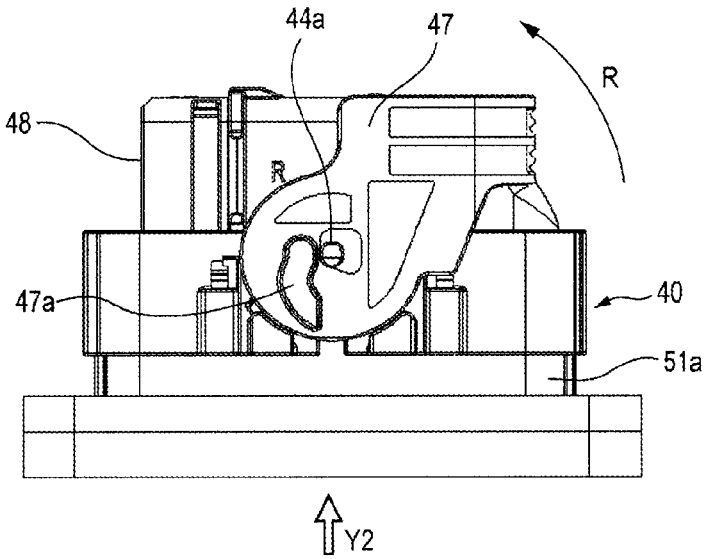
FIG. 14 is a side view of a state where the connector receiving member and connector body shown in FIG. 13 are butted against each other at a fitting start position.
Figure 15:
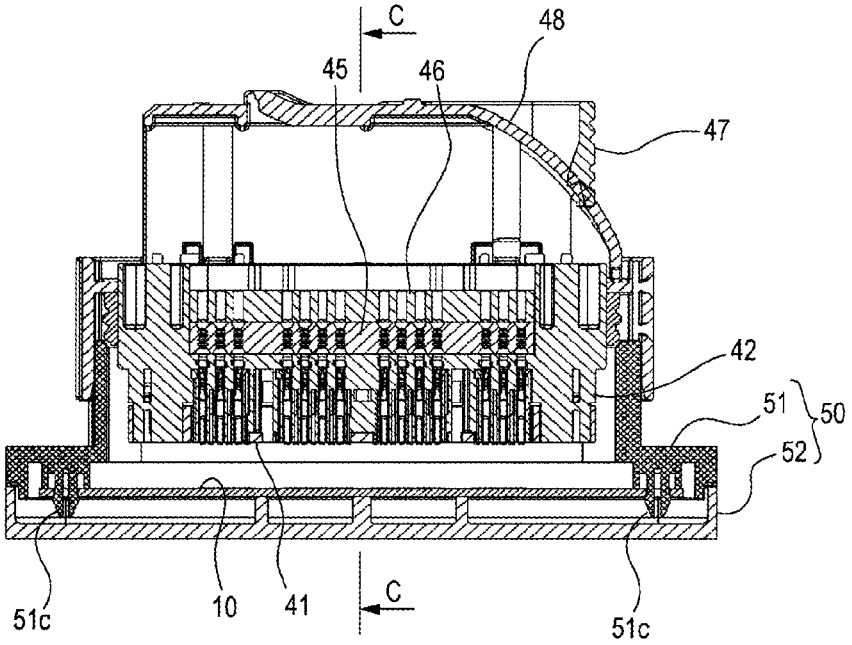
FIG. 15 is a longitudinal sectional view of the board connector shown in FIG. 14.
Figure 16:
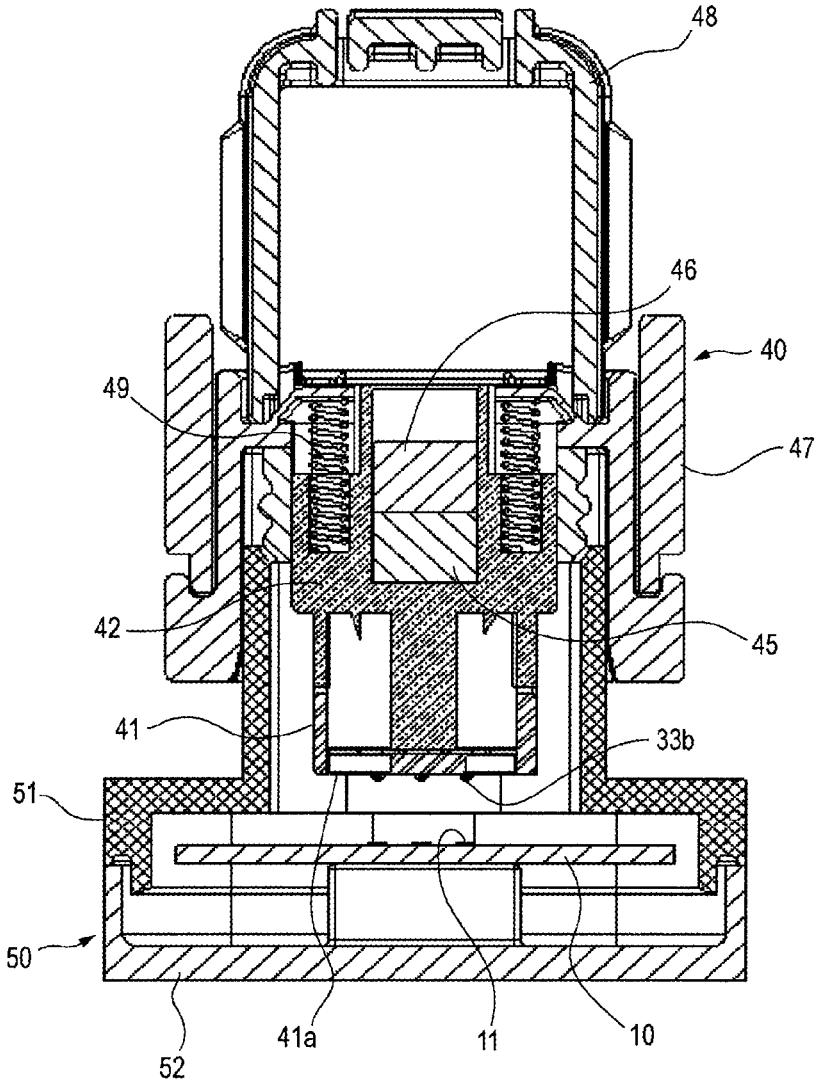
FIG. 16 is a sectional view taken along C-C in FIG. 15.
Figure 17:
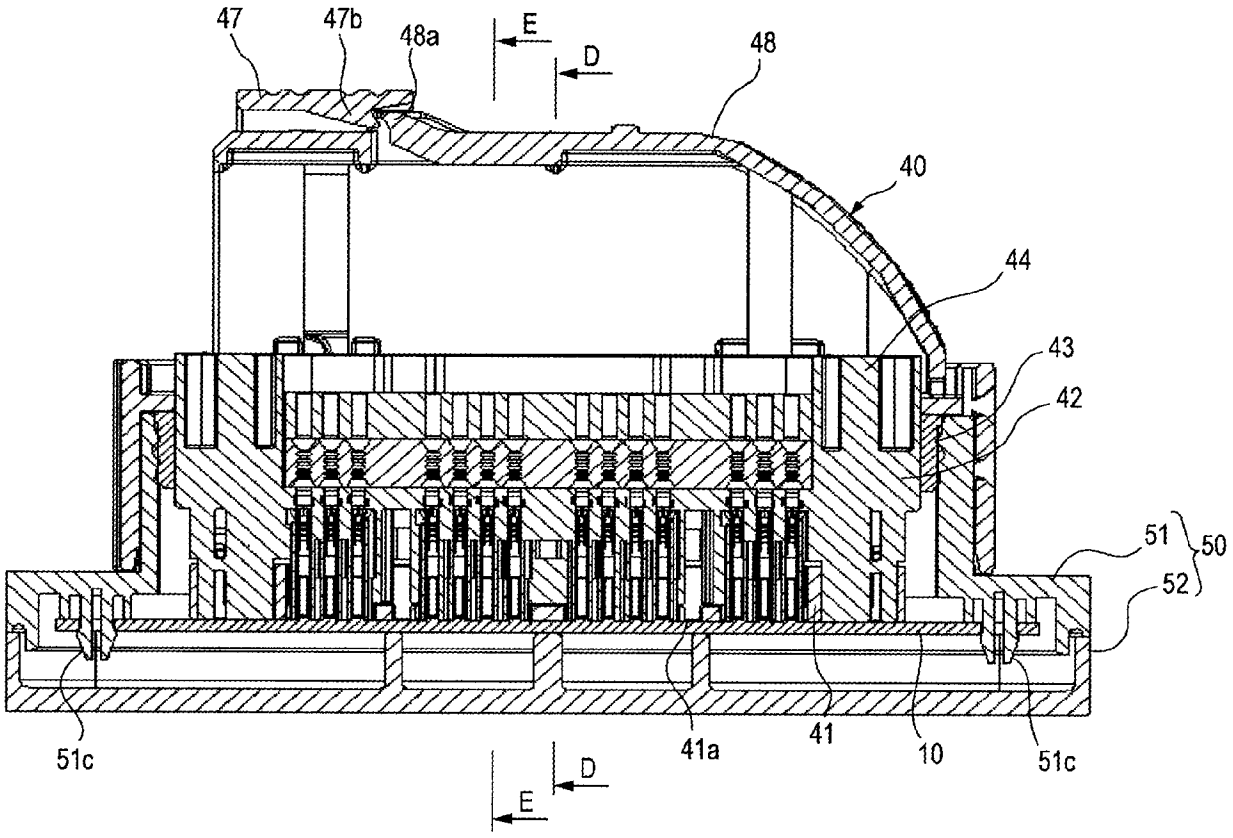
FIG. 17 is a longitudinal sectional view of a state where the connector body in the embodiment is fitted to the connector receiving member by an operation of swinging a fitting operation lever.
Figure 18:
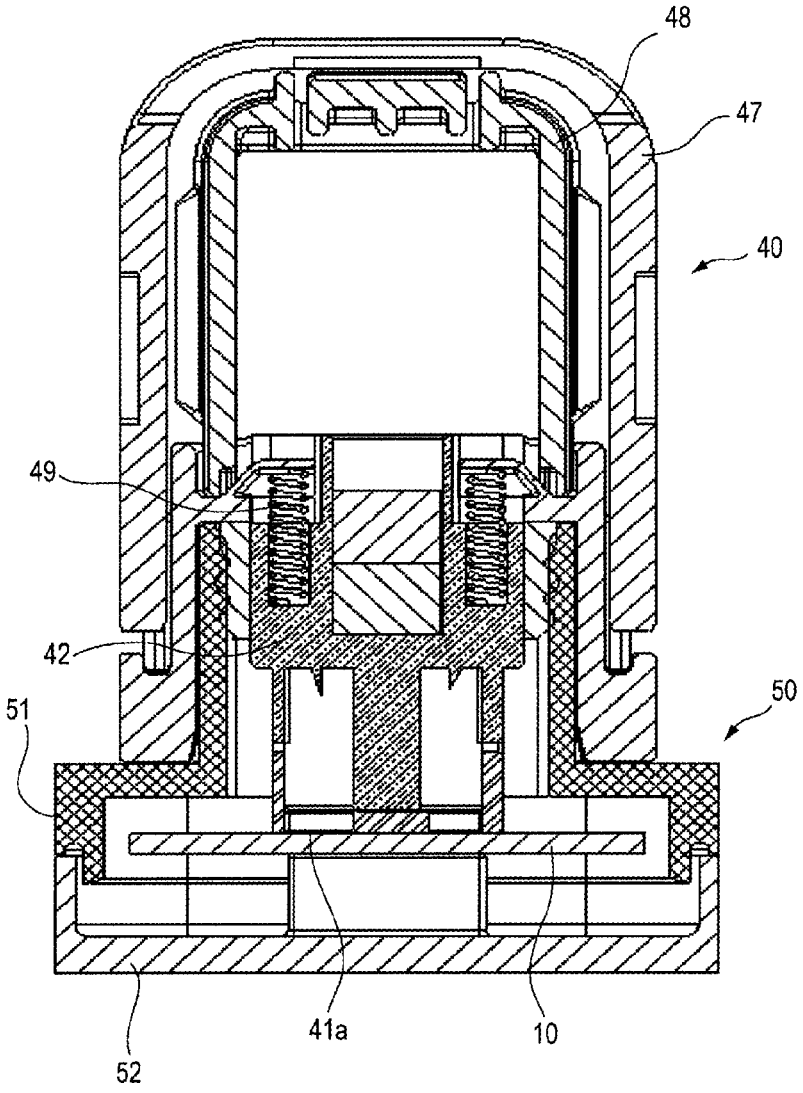
FIG. 18 is a sectional view taken along D-D in FIG. 17.
Figure 19:
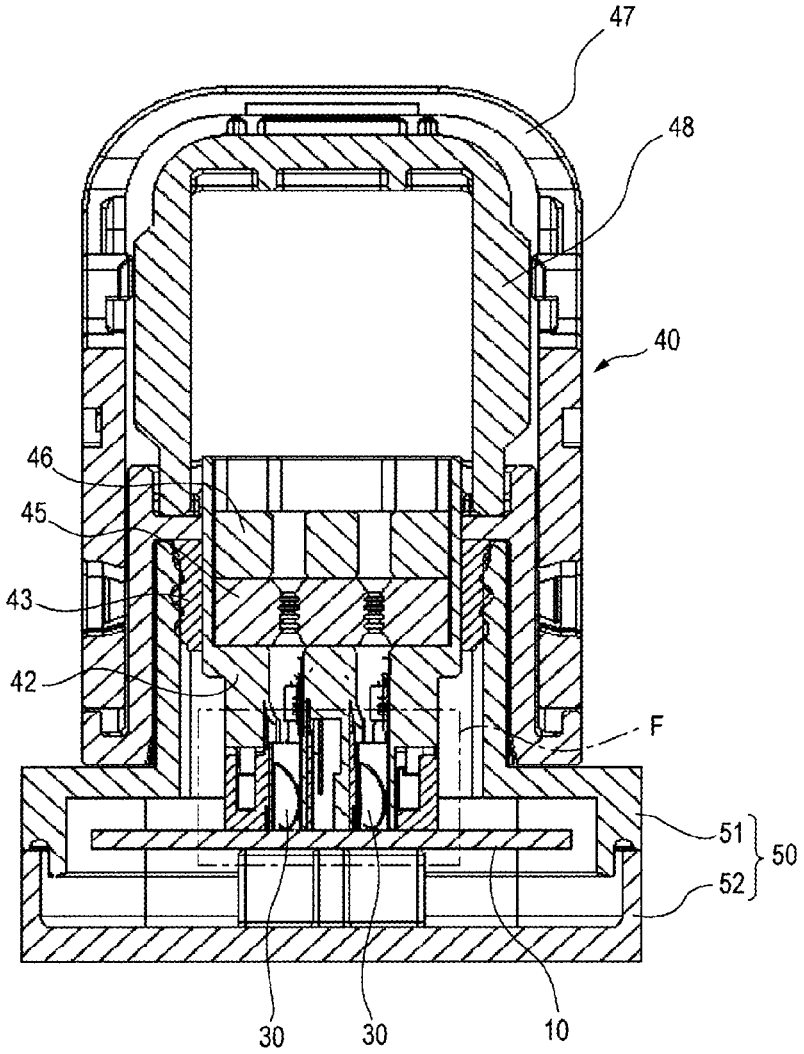
FIG. 19 is a sectional view taken along E-E in FIG. 17.
Figure 20:
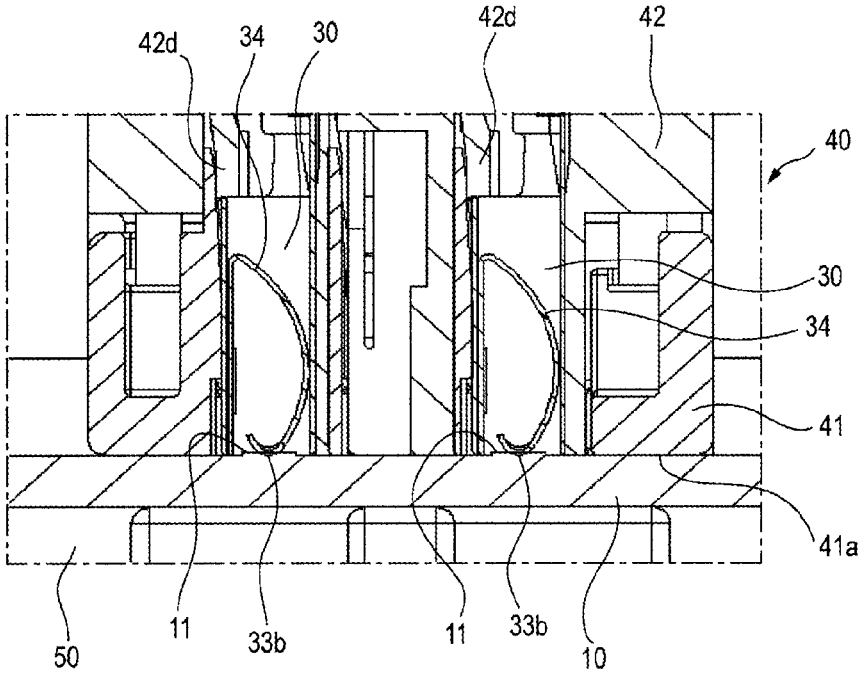
FIG. 20 is an enlarged view of portion F of FIG. 19.
Figure 21:
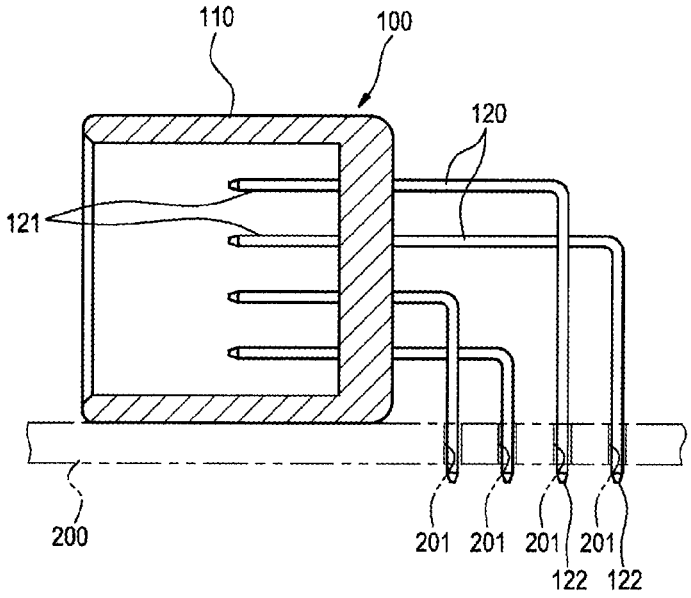
FIG. 21 is a longitudinal sectional view of a related-art board connector.

FIGS. 1 to 20 show an embodiment of the board connector of the invention. FIG. 1 is an exploded perspective view of the embodiment of the board connector of the invention, FIG. 2 is a perspective view of a circuit board shown in FIG. 1, as viewed from the surface side, FIG. 3 is a longitudinal sectional view of a terminal fitting shown in FIG. 1, FIG. 4 is an exploded perspective view of a connector body shown in FIG. 1, FIG. 5 is a perspective view of a state where inner and outer housings in the embodiment to which housing urging springs have not yet been attached are opposed to each other before assembly, FIG. 6 is a perspective view of a state where the inner and outer housings in the embodiment to which the housing urging springs have been attached are opposed to each other before assembly, FIG. 7 is a longitudinal sectional view of the inner and outer housings in the embodiment after assembly, FIG. 8 is a front view of the connector body in the embodiment after assembly, FIG. 9 is a sectional view taken along A-A in FIG. 8, FIG. 10 is an enlarged view of portion B of FIG. 9, FIG. 11 is a longitudinal sectional view of a state where terminal fittings are attached to the connector body in the embodiment, FIG. 12 is a perspective view of a state where, in the embodiment, a connector receiving member and the connector body are opposed to each other, FIG. 13 is a side view of the connector receiving member and connector body shown in FIG. 12, FIG. 14 is a side view of a state where the connector receiving member and connector body shown in FIG. 13 are butted against each other at a fitting start position, FIG. 15 is a longitudinal sectional view of the board connector shown in FIG. 14, FIG. 16 is a sectional view taken along C-C in FIG. 15, FIG. 17 is a longitudinal sectional view of a state where the connector body in the embodiment is fitted to the connector receiving member by an operation of swinging a fitting operation lever, FIG. 18 is a sectional view taken along D-D in FIG. 17, FIG. 19 is a sectional view taken along E-E in FIG. 17, and FIG. 20 is an enlarged view of portion F of FIG. 19.

Figure 2:
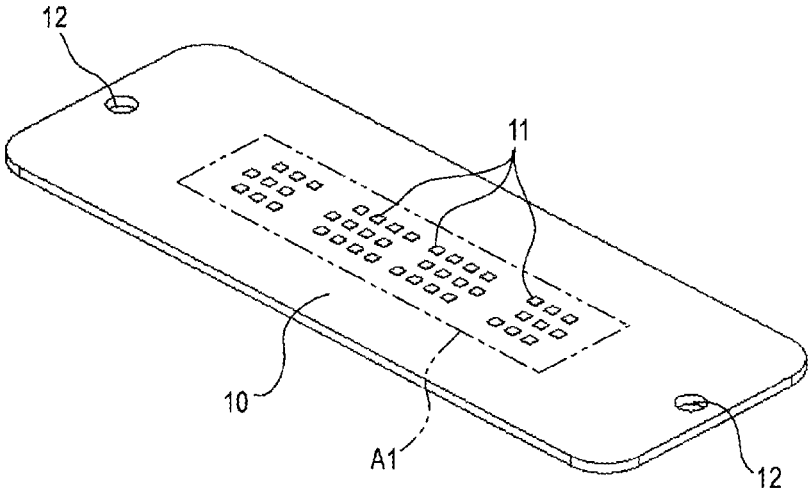
FIG. 2 is a perspective view of a circuit board shown in FIG. 1, as viewed from the surface side.
Figure 3:
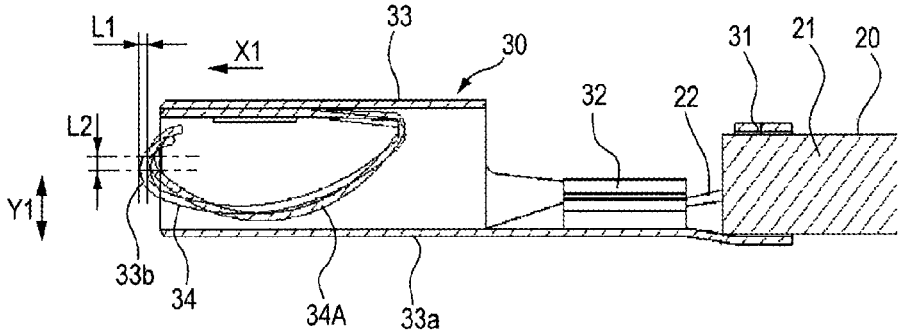
FIG. 3 is a longitudinal sectional view of a terminal fitting shown in FIG. 1.

As shown in FIGS. 1 to 3, the board connector 1 of the embodiment is a connector through which the plurality of terminal fittings 30 connected to cables 20 extended from an external apparatus are electrically connected to the plurality of contact patterns 11 arranged on the circuit board 10 at a predetermined arrangement pitch, respectively.

The circuit board 10 to which the board connector 1 of the embodiment is to be connected is a multi-layer circuit board in which circuit patterns and electronic circuits are formed on middle layers. As shown in FIG. 2, the contact patterns 11 are arranged at the predetermined arrangement pitch on one surface of the circuit board. Attachment holes 12 are formed on the both sides of an area A1 where the contact patterns 11 are formed. The attachment holes are used for attaching the circuit board 10 to a receiving member body 51 to which the board connector 1 is to be matingly fitted, and which will be described later.

Each of the terminal fittings 30 which are to be connected to the cables 20 extended from the external apparatus is a molded product that is formed by pressing a metal plate, and, as shown in FIGS. 1 and 3, includes a cover fixing piece 31 that is crimped to a covering portion 21 of the cable 20, a conductor crimping piece 32 that is crimped to the conductor 22 of the cable 20, and a box-like portion 33 that is to be connected to one of the contact patterns 11.

In the box-like portion 33, a contact portion 33*b* is projected from the tip end of a terminal body 33*a* which is formed by molding a metal plate into a rectangular tubular shape. The contact portion 33*b* is contacted with the contact pattern 11, to be electrically connected to the contact pattern 11. In the embodiment, the contact portion 33*b* is a spring piece 34 which performs predetermined elastic deformation by being contacted with the contact pattern 11, thereby exerting a predetermined contact pressure on the contact pattern 11.

When the contact portion 33*b* in the embodiment is elastically deformed by butting against the contact pattern 11, the portion is elastically displaced by a distance L1 in the direction (direction of the arrow X1 in FIG. 3) along which the portion is butted against the contact pattern 11, to obtain the predetermined contact pressure which is necessary for electrical connection. The bending shape of the spring piece 34 is set so that, when the contact portion 33*b* is elastically deformed by butting against the contact pattern 11, the contact portion is elastically displaced by a distance L2 in the surface direction (direction of the arrow Y1 in FIG. 3) of the contact pattern 11 so as to scrub the surface of the contact pattern 11.

FIG. 3 shows a state where, in a hatched spring piece 34A, the tip end surface of a contact portion 33*b* is butted against the contact pattern 11, whereby the spring piece 34 is elastically deformed.

The board connector 1 of the embodiment includes the connector body 40 which houses and holds the terminal fittings 30 at an arrangement pitch corresponding to that of the contact patterns 11 on the circuit board 10, and the connector receiving member 50 which is to be attached to the circuit board 10.

As shown in FIG. 4, the connector body 40 is configured by a front holder 41, the inner housing 42, the housing urging springs 49, a packing 43, the outer housing 44, a mat seal 45, a mat seal cover 46, the fitting operation lever 47, a back cover 48, etc. The connector body houses and holds the terminal fittings 30 at the arrangement pitch corresponding to that of the contact patterns 11.

As shown in FIGS. 5 to 7, the front holder 41 is fittingly connected to the tip end of the inner housing 42. The tip end surface 41*a* of the front holder 41 is the tip end surface of the connector body 40 which is to be butted against the circuit board 10.

The rear end side of the inner housing 42 is fitted to a housing support hole portion 44*c* of the outer housing 44 so as to be slidable along a fitting direction (direction of the arrow X1 in FIGS. 6 and 7) along which the connector body 40 and the connector receiving member 50 are fitted to each other. As shown in FIGS. 5 and 6, outer coupling projections 42*a* are protruded from a rear end portion of the inner housing 42 which is fitted to the housing support hole portion 44*c*. The outer coupling projections 42*a* are protruded from the upper and lower outer side surfaces of the rear end portion of the inner housing 42. When the rear end portion of the inner housing 42 is inserted into the housing support hole portion 44*c*, the outer coupling projections 42*a* are engaged with a step 44*b* of the housing support hole portion 44*c*, thereby preventing the inner housing 42 from slipping off from the outer housing 44.

Therefore, the outer housing 44 supports the inner housing 42 so that the inner housing 42 is slidable along the fitting direction of the connector body 40 and the connector receiving member 50.

As shown in FIGS. 11 and 12, the back cover 48 is fittingly attached to the outer housing 44.

As shown in FIG. 6, the inner housing 42 has spring support holes 42*b* which house one ends of the housing urging springs 49, respectively. In the embodiment, the housing urging springs 49 are compression coil springs. The spring support holes 42*b* are circular holes which house one ends of the housing urging springs 49 in an extensible and contractible manner.

When the inner housing 42 is fitted to the housing support hole portion 44*c* of the outer housing 44, the housing urging springs 49 in which the one ends are housed in the spring support holes 42*b* are clamped in a compressed state between the inner housing 42 and the outer housing 44 as shown in FIG. 7. Therefore, the housing urging springs 49 urge the inner housing 42 in the direction along which it is projected from the outer housing 44 (the direction of the arrow X2 in FIG. 7).

In the inner housing 42, as shown in FIGS. 9 and 10, terminal housing holes 42*c* which house the terminal fittings 30, respectively are penetratingly formed in the tip end side. As shown in FIG. 9, the inner housing 42 has a mat housing space 42*e* which communicates with the rear ends of the terminal housing holes 42*c*, and which houses and holds the mat seal 45 and the mat seal cover 46.

As shown in FIG. 11, the mat seal 45 which is attached into the mat housing space 42*e* is closely contacted with the outer peripheries of the cables 20 connected to the terminal fittings 30 to make passing portions of the cables 20 watertight. The mat seal cover 46 which is attached into the mat housing space 42*e* is tightly fitted to the mat housing space 42*e* to press the mat seal 45.

The front holder 41 which is connected to the tip end of the inner housing 42 has tip-end holding holes 41*c* which communicate with the terminal housing holes 42*c*, respectively. As shown in FIG. 11, each of the tip-end holding holes 41*c* is formed by a hole which surrounds the periphery of a tip end portion of the terminal fitting 30 inserted into the terminal housing hole 42*c*, and prevents the tip end portion of the terminal fitting 30 from rattling.

As shown in FIGS. 10 and 11, the inner housing 42 includes retaining lances 42*d* which oppose the terminal housing holes 42*c*, respectively. Each of the retaining lances 42*d* is engaged with a step of the rear end of the box-like portion 33 of the terminal fitting 30 which is inserted into the corresponding terminal housing hole 42*c*, thereby preventing the terminal fitting 30 from slipping off. The retaining lance 42*d* engagingly locks the terminal fitting 30 so that the tip end surface (contact portion 33*b*) of the terminal fitting 30 is projected from the tip end surface 41*a* of the connector body 40. Namely, the inner housing 42 in the embodiment engagingly locks the terminal fitting 30 so that the contact portion 33*b* which is the tip end surface of the terminal fitting 30 is projected from the tip end surface 41*a* of the connector body 40.

As shown also in FIGS. 12 and 13, the fitting operation lever 47 disposed in the connector body 40 is swingably attached to lever support shafts 44*a* protruded from the both side surfaces of the outer housing 44. Cam grooves 47*a* which are to be engaged with boss portions 51*b* of the connector receiving member 50, which will be described later, is formed with the fitting operation lever 47. When the connector body 40 and the connector receiving member 50 which will be described later are located at the fitting start position as shown in FIG. 14, the boss portions 51*b* disposed in the connector receiving member 50 are engaged with the respective start ends of the cam grooves 47*a*. As shown in FIG. 14, then, the fitting operation lever 47 is swung in a predetermined direction (direction of the arrow R in FIG. 14), and the cam groove 47*a* pulls in the boss portion 51*b* of the connector receiving member 50 along the fitting direction of the connector body 40, whereby the connector body 40 is fitted to the connector receiving member 50 to set the connector body 40 and the connector receiving member 50 to a coupled state.

The back cover 48 which is disposed in the connector body 40 is coupled to the rear portion of the outer housing 44 to restrict the direction of drawing out the cables 20 which are to be housed in the connector body 40.

The connector receiving member 50 is a member which engagingly locks the tip end surface of the connector body 40 in a state where the tip end surface of the connector body 40 is butted against the surface of the circuit board 10, and is attached to the circuit board 10 in advance.

As shown in FIG. 1, the connector receiving member 50 in the embodiment includes the receiving member body 51 which is attached to a surface side of the circuit board 10, and a rear surface cover 52 which is to be coupled to the receiving member body 51 while covering the rear surface side of the circuit board 10.

As shown in FIGS. 1 and 2, the receiving member body 51 includes a tubular portion (hood portion) 51*a* to which the connector body 40 is fitted, the boss portions 51*b* which are protruded from the outer surface of the tubular portion 51*a*, and board engaging portions 51*c* which are fitted into the attachment holes 12 of the circuit board 10 to attain coupling with the circuit board 10.

When the connector body 40 starts to be inserted into the receiving member body 51, the boss portions 51*b* which are protruded from the outer surface of the receiving member body 51 are engaged with the cam grooves 47*a* of the fitting operation lever 47, and then pulled toward the connector body 40 by the operation of swinging the fitting operation lever 47, thereby setting the connector receiving member 50 and the connector body 40 to the coupled state.

Next, the procedure of electrically connecting the terminal fittings 30 connected to the cables 20 extended from the external apparatus, to the contact patterns 11 of the circuit board 10 will be described with reference to FIGS. 13 to 20.

The connector receiving member 50 is attached to the circuit board 10 in advance, and the terminal fittings 30 are held by the connector body 40.

As shown in FIG. 13, then, the tip end surface of the connector body 40 is first opposed to the tubular portion 51*a* of the connector receiving member 50.

As shown in FIGS. 14 and 16, then, the connector body 40 is butted against the connector receiving member 50, and they are located at the fitting start position. In the state where the connector receiving member 50 and the connector body 40 are located at the fitting start position, the boss portions 51*b* disposed in the receiving member body 51 are engaged with the start ends of the cam grooves 47*a* of the fitting operation lever 47. In this state, as shown in FIG. 16, the tip end surface of the connector body 40 is separated from the surface of the circuit board 10, and the contact portions 33*b* of the terminal fittings 30 are not contacted with the contact patterns 11.

When the fitting operation lever 47 is then swung in the direction of the arrow R in FIG. 14, the boss portions 51*b* of the receiving member body 51 are pulled in the direction of the arrow Y2 in FIG. 14 by the cam grooves 47*a* of the fitting operation lever 47 in accordance with the swinging operation of the fitting operation lever 47, and the fitting between the connector body 40 and the connector receiving member 50 is enhanced.

As shown in FIGS. 17 and 18, when the fitting operation lever 47 is swung to the end of the swing range, then, the fitting of the connector receiving member 50 to the connector body 40 is completed. When the fitting of the connector receiving member 50 to the connector body 40 is completed, a lever engagement projection 48*a* disposed in the back cover 48 is engaged, as shown in FIG. 17, with a locking step 47*b* which is formed in the opposing surface of the fitting operation lever 47, and the return of the fitting operation lever 47 is restricted. Therefore, the coupled state between the connector body 40 and the connector receiving member 50 is locked.

When the coupled state between the connector body 40 and the connector receiving member 50 is locked, a state is attained where the tip end surface 41*a* of the connector body 40 is pressingly contacted with the surface of the circuit board 10 as shown in FIGS. 17 and 18. In this time, furthermore, the contact portions 33*b* which are disposed in the terminal fittings 30, and which are protruded from the tip end surface 41*a* are butted against the surfaces of the contact patterns 11 as shown in FIGS. 19 and 20. Then, the contact portions 33*b* which are butted against the contact patterns 11 are pressingly contacted with the contact patterns 11 by elastic deformations of the spring pieces 34, and the terminal fittings 30 and the contact patterns 11 are electrically contacted to each other.

In the above-described board connector 1 of the embodiment, electrical connections between the terminal fittings 30 connected to the cables 20 extended from the external apparatus, and the contact patterns 11 on the circuit board 10 are realized by coupling the connector body 40 to the connector receiving member 50 on the circuit board 10, and butting the tip end surface 41*a* of the connector body 40 against the surface of circuit board 10, to butt the tip end surfaces (contact portions 33*b*) of the terminal fittings 30 held by the connector body 40, against the contact patterns 11 on the circuit board 10.

When the cables 20 extended from the external apparatus are to be electrically connected to the contact patterns 11 on the circuit board 10, therefore, it is not necessary to conduct time-consuming soldering work on the circuit board 10.

Moreover, the electrical connections between the terminal fittings 30 connected to the cables 20 extended from the external apparatus and the contact patterns 11 on the circuit board 10 are realized by butting of the terminal fittings and the contact patterns, and mating fittings of terminal fittings which may cause collision or prying during a connecting operation do not exist. Consequently, there is no possibility that the terminal fittings 30 may be broken by collision or prying during a connecting operation.

Therefore, the terminal fittings 30 connected to the cables 20 extended from the external apparatus can be easily electrically connected to the contact patterns 11 on the circuit board 10.

In the state where the connector body 40 is coupled to the connector receiving member 50, the inner housing 42 which engagingly locks the terminal fittings 30 is urged toward the circuit board 10 by the housing urging springs 49. Therefore, the terminal fittings 30 engagingly locked to the inner housing 42 can be pressingly contacted with the contact patterns 11 at a predetermined contact pressure. Moreover, dimension and assembly errors of the connector body 40 can be absorbed by extension and contraction of the housing urging springs 49. Therefore, a stable electrical connection state can be ensured without being affected by dimension and assembly errors of the connector body 40, and the reliability of the connections between the contact patterns 11 and the terminal fittings 30 can be improved.

In the above-described board connector 1 of the embodiment, in the terminal fittings 30, moreover, the contact portions 33*b* which are butted against the contact patterns 11 are the spring pieces 34 which are caused to perform predetermined elastic deformation by being butted against the contact patterns 11, thereby exerting the predetermined contact pressures on the contact patterns 11. As compared with the case where the tip ends of the terminal fittings 30 are pressingly contacted with the contact patterns 11 by only the urging forces of the housing urging springs 49, therefore, the contact pressures can be further finely adjusted, the shock which acts on the terminal fittings 30 in the press contact can be relaxed, and the reliability of the connections between the contact patterns 11 and the terminal fittings 30 can be further improved.

In the above-described board connector 1 of the embodiment, when the contact portions 33*b* of the terminal fittings 30 are butted against the contact patterns 11 on the circuit board 10, furthermore, the contact portions 33*b* scrub the surfaces of the contact patterns 11 during the elastic deformation, respectively, and wiping which is effective in removal of oxide films on the contacting surface is performed. Therefore, reduction of electrical connection characteristics due to such oxide films can be prevented from occurring.

In the above-described board connector 1 of the embodiment, furthermore, the coupling between the connector body 40 and the connector receiving member 50 can be easily realized by swinging the fitting operation lever 47, and the work of coupling the connector body 40 with the connector receiving member 50 can be facilitated.

The invention is not limited to the above-described embodiment, and may be adequately subjected to modifications, improvements, and the like. In addition, the materials, shapes, dimensions, numbers, places, and the like of the components of the above-described embodiment are arbitrary and not limited insofar as the invention is achieved.

For example, the above-described embodiment is configured so that the circuit board 10 is housed in the connector receiving member 50. However, the size of the circuit board 10 is not limited to that in the embodiment. For example, a configuration may be contemplated where the circuit board 10 is larger in size than the connector receiving member 50, and a plurality of board connectors 1 are connected onto one circuit board 10.

Moreover, also the specific structure of the connector receiving member 50 which is attached to the circuit board 10 is not limited to that in the embodiment. For example, the connector receiving member 50 may have a structure where the rear surface cover 52 is omitted.

In the embodiment, furthermore, the fitting operation lever 47 which is swingably disposed in the connector body 40 is used in the coupling between the connector body 40 and the connector receiving member 50. Alternatively, a configuration may be employed where the fitting operation lever 47 is not used, and the connector body 40 and the connector receiving member 50 are set to the coupled state by, for example, engaging projections disposed on the connector body 40 with engaging portions disposed on the connector receiving member 50.

In the board connector of the invention, the terminal fittings 30 which are housed and held in the connector body 40 may be singular or plural, and an adequate number of terminal fittings may be set as required.

According to the invention, the terminal fittings connected to the cables extended from the external apparatus can be easily electrically connected to the contact patterns on the circuit board.

What is claimed is:

1. A board connector comprising:

a connector body which houses and holds a terminal fitting, connected to a cable extended from an external apparatus and corresponding to a contact arranged on a circuit board; and a connector receiving member which is attached to the circuit board, and which engagingly locks a tip end surface of the connector body in a state where the tip end surface of the connector body is butted against a surface of the circuit board, wherein the connector body includes:

an inner housing which engagingly locks the terminal fitting so that a tip end surface of the terminal fitting is projected from the tip end surface of the connector body;

an outer housing which supports the inner housing so that the inner housing is slidable in a fitting direction along which the connector body and the connector receiving member are fitted to each other; and a housing urging spring which is disposed between the inner housing and the outer housing in a compressed state to urge the inner housing in a projecting direction along which the inner housing is projected from the outer housing, and the tip end surface of the terminal fitting is pressingly contacted with the contact, thereby causing the terminal fitting to be electrically connected to the contact.

2. The board connector according to claim 1, wherein the terminal fitting includes a contact portion which is contacted with the contact and which is a spring piece configured to perform predetermined elastic deformation by being contacted with the contact, thereby exerting a predetermined contact pressure on the contact.

3. The board connector according to claim 2, wherein when the contact portion of the terminal fitting performs the elastic deformation by being contacted with the contact, the contact portion is elastically displaced in a surface direction of the contact so as to scrub a surface of the contact.

4. The board connector according to claim 1, wherein the connector receiving member includes a tubular portion to which the connector body is fitted and which includes a boss portion protruded from an outer surface of the tubular portion, and the connector body includes a fitting operation lever which is configured to perform a swinging operation and which is formed with a cam groove that is configured to pull in the boss portion in the fitting direction in accordance with the swinging operation of the fitting operation lever, thereby causing the connector body to be fitted to the connector receiving member.

* * * * *